US007464635B2

(12) United States Patent
Rantala et al.

(10) Patent No.: US 7,464,635 B2
(45) Date of Patent: Dec. 16, 2008

(54) PERCUSSION DEVICE WITH A CONTROL VALVE FOR TWO ALTERNATELY STRIKING PISTONS

(75) Inventors: Esa Rantala, Kyrönlahti (FI); Jarmo Heinonen, Tampere (FI); Antti Koskimäki, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 384 days.

(21) Appl. No.: 10/840,640

(22) Filed: May 7, 2004

(65) Prior Publication Data

US 2004/0251038 A1 Dec. 16, 2004

Related U.S. Application Data

(63) Continuation of application No. PCT/FI02/00868, filed on Nov. 7, 2002.

(30) Foreign Application Priority Data

Nov. 7, 2001 (FI) ..... 20012156

(51) Int. Cl.
*F01L 25/04* (2006.01)
*F01L 25/08* (2006.01)

(52) U.S. Cl. ..... 91/193; 91/275; 91/300; 60/374

(58) Field of Classification Search ..... 91/191, 91/193, 235, 300; 60/374
See application file for complete search history.

(56) References Cited

U.S. PATENT DOCUMENTS

| | | | | |
|---|---|---|---|---|
| 2,660,955 | A * | 12/1953 | Kent et al. | 91/191 |
| 3,425,498 | A | 2/1969 | Bick | |
| 3,864,852 | A | 2/1975 | Lochrie | |
| 4,477,232 | A * | 10/1984 | Mayer | 91/193 |
| 4,825,960 | A | 5/1989 | Krone | |
| 5,653,295 | A * | 8/1997 | Juvonen et al. | 91/300 |
| 6,073,706 | A | 6/2000 | Niemi | |

FOREIGN PATENT DOCUMENTS

| | | |
|---|---|---|
| EP | 1157787 A | 11/2001 |
| FI | 751769 | 12/1975 |
| FR | 2 263 398 A | 1/1975 |
| JP | 6002480 | 1/1994 |
| JP | 6002481 | 1/1994 |
| RO | 112705 | 3/1997 |
| SE | 7401334 A | 8/1975 |

* cited by examiner

*Primary Examiner*—F. Daniel Lopez
(74) *Attorney, Agent, or Firm*—Drinker Biddle & Reath LLP

(57) ABSTRACT

The invention relates to a percussion device comprising two percussion pistons alternately making a percussion motion and a control valve for controlling the percussion pistons. The control valve (7) comprises a slide (8) affected by a force so that the slide is generally in a first position, but moves at the end of the percussion motion of the first percussion piston from the first position to a second position and correspondingly back to the first position at the end of the percussion motion of the second percussion piston (4).

10 Claims, 7 Drawing Sheets

PERCUSSION DEVICE WITH A CONTROL VALVE FOR TWO ALTERNATELY STRIKING PISTONS

BACKGROUND OF THE INVENTION

The invention relates to a two-piston percussion device comprising two percussion pistons alternately making a percussion motion in order to deliver an impact on a tool and a control valve for controlling the movement of the percussion pistons, where both percussion pistons are provided with a first pressure space and both percussion pistons comprise a first pressure surface facing the tool and communicating with said first pressure space, both percussion pistons comprise at the back end thereof a second pressure space and both percussion pistons comprise a second pressure surface directed backwards and with a surface area larger than that of the first pressure surface communicating with the second pressure space, whereby the pressure of the pressure fluid is constantly high in the first pressure space during the operation of the percussion device, and whereby the second pressure space of both percussion pistons is connected to the high pressure of the pressure fluid and correspondingly to the low pressure of the pressure fluid in order to alternately obtain a percussion motion and correspondingly a return motion, and control means for controlling the control valve with the percussion motion of both percussion pistons.

Percussion devices comprising several percussion pistons are known to be used in rock drilling apparatuses. Such apparatuses are known for instance from Japanese patent application No. 4-156914 and 4-186221. Furthermore, Rumanian patent 112705 discloses a percussion device including two pistons alternately delivering a percussion motion on a tool and a control valve that changes position while the pistons move at a particular stage of the movement of the pistons in such a manner that the pistons move in opposite directions in turns. In this solution, the valve is controlled so that a closed space is provided on opposite sides of the pistons in relation to one another, from where compressed air is able to flow only to one side of the valve and causing the position of the valve to change. However, such a solution is difficult to apply to hydraulic percussion devices, in which the rate of flow used and required for controlling the valve is very small and such a structure would therefore cause unnecessary efficiency losses. Removing large amounts of liquid flow also causes difficulties, as the hydraulic fluid is not compressed like air.

BRIEF DESCRIPTION OF THE INVENTION

It is an object of the present invention to provide such a hydraulic percussion device, in which the percussion motion is simply and easily controlled with losses that are as small as possible. The percussion device according to the invention is characterized in that the control valve comprises a slide affected by a force in the direction of motion thereof so that the slide is generally in the first position thereof, where the control valve has connected the high pressure of the pressure fluid to act on a channel leading to the second pressure space of the first percussion piston and correspondingly the second pressure space of the second percussion piston in connection with a discharge channel of the pressure fluid, that control means are connected to act on the slide of the control valve at the end of the percussion motion of the first percussion piston so that the slide moves from a first position to a second position, whereby the control valve connects the second pressure space of the first percussion piston in connection with the discharge channel of the pressure fluid and correspondingly the high pressure of the pressure fluid to act on the channel leading to the second pressure space of the second percussion piston, and in that the control means are connected at the end of the percussion motion of the second percussion piston to act on the slide of the control valve so that the slide again moves from the second position to the first position.

An essential idea of the invention is that a force is placed upon the control valve that tends to keep the control valve in a particular position, and while the control valve is in this particular position the pressure of a pressure medium acts on the first percussion piston so that the first percussion piston performs a percussion motion and correspondingly the pressure of the pressure medium acts on the second percussion piston so that said percussion piston performs a return motion. Another essential idea of the invention is that the movement of the percussion pistons in the percussion direction controls the operation of the control valve so that when the percussion piston in percussion motion arrives at a predetermined position at the end of the percussion motion thereof, it controls the control valve in such a manner that the control valve changes the position thereof and engages said percussion piston to the return motion and simultaneously allows the percussion motion of the second percussion piston being at the end of its return motion. Furthermore, an essential idea of a preferred embodiment of the invention is that when the first percussion piston arrives at the end of the percussion motion thereof to a predetermined position, it opens a pressure medium channel for a pressure surface in the control valve, on which the affecting pressure of the pressure medium provides a force that is opposite in relation to said force and greater than said force so that the control valve moves to the second position, where the pressures of the pressure medium controlled by the control valve act upon the first and second percussion piston so that the direction of motion thereof change to the opposite. A further essential idea of a preferred embodiment of the invention is that at the end of the percussion motion of the second percussion piston at a predetermined position, the percussion piston controls such a pressure of the pressure medium on said pressure surface of the control valve, preferably with what is known as the tank pressure, the force thereof provided on said pressure surface being smaller than the force tending to move the control valve to the first position, in which case the control valve again changes position and once again controls the movements of the percussion pistons to opposite directions. Still a further essential idea of a preferred embodiment of the invention is that the opposite end of both percussion pistons regarding the tool comprises an extension and a shoulder therein and that a high-pressure pressure fluid channel is connected to the path of the shoulder so that at the end of the return motion of the percussion piston the shoulder moves away from the channel allowing a high-pressure pressure fluid to act on the percussion piston in question in order to start the percussion motion, and as the percussion motion of the percussion piston has started the shoulder once again closes said connection and the percussion motion of the percussion piston continues by the effect of the high-pressure pressure fluid arriving from the control valve.

BRIEF DESCRIPTION OF THE DRAWINGS

In the following, the invention will be explained in greater detail by means of the accompanying drawings, in which FIGS. 1 to 4 schematically show the operation of an embodiment of a percussion device according to the invention, FIG. 5 schematically shows another embodiment of the percussion device according to the invention, FIG. 6 schematically shows a third embodiment of the percussion device according to the invention, and FIG. 7 schematically shows a fourth embodiment of the percussion device according to the invention.

DETAILED DESCRIPTION OF THE INVENTION

Figure 1:
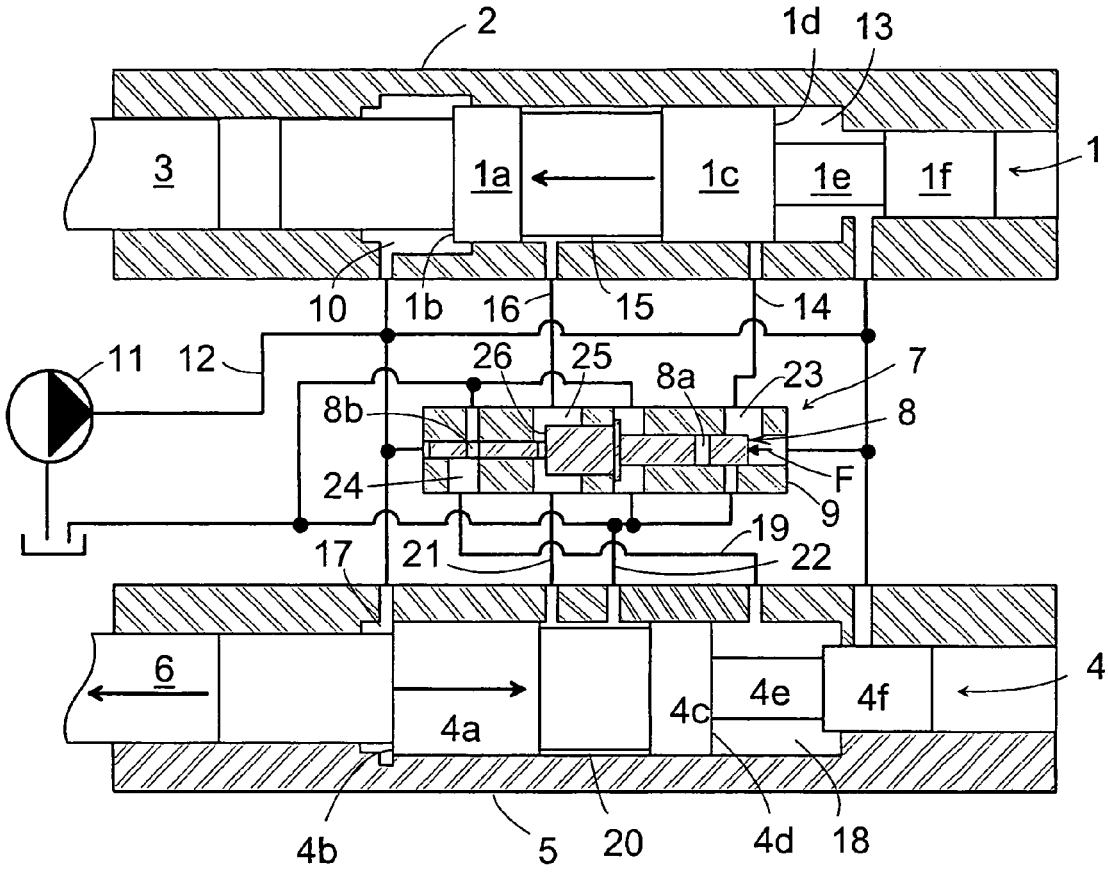

FIG. 1 shows a percussion device provided with two percussion pistons, for the sake of clarity as two separate percussion mechanisms, whose percussion pistons axially strike different parts. The Figures show a first percussion piston 1 that moves in a first part 2 of the frame. In front of the percussion piston there is provided a first tool 3, which may be a shank known per se or an actual tool. Furthermore, the Figure shows a second percussion piston 4, which moves in a second part 5 of the frame and in front thereof, on the left of the Figure, is a second tool 6, which may also be a shank known per se or an actual tool. The parts 2 and 5 of the frame will from here on be referred to as the frame, since the parts 2 and 5 of the frame may be separate frames that are not fixedly connected to one another or they may form a part of the same fixed frame. Furthermore, the Figure shows a control valve 7 formed by a valve slide 8 that moves in a valve frame 9. The valve frame 9 may either be a fully separate frame that is not fixedly connected to the frame of the percussion device or it may form a fixed part in the frame of the percussion device.

The first percussion piston comprises on the front side in the percussion direction thereof, i.e. on the left in the Figure, a shoulder 1*a* comprising a first pressure surface 1*b* on the side of the tool. This pressure surface is connected to a first pressure space 10 of the first percussion piston, where a constant high pressure of the pressure medium prevails, and which is schematically shown from a hydraulic pump 11 along a channel 12. The first percussion piston 1 also comprises a second shoulder 1*c*, which correspondingly comprises a second pressure surface 1*d* facing the back end of the percussion piston, i.e. on the right in the Figure. The second pressure surface 1*d* communicates in turn with a second pressure space 13 of the first percussion piston, which in turn is connected through a channel 14 to the control valve 7 for most of the percussion motion, although the second shoulder 1*c* of the percussion piston 1 closes the connection at the end of the movement of the percussion piston. The first percussion piston further comprises an extension 1*e* and a third shoulder 1*f* at the end thereof extending backwards from said percussion piston, i.e. on the right in the Figure. A constant high-pressure pressure medium, the flow of which the third shoulder controls while the first percussion piston moves back and forth, is supplied from the pump 11 to the third shoulder 1*f*. A part that is smaller in diameter than the shoulders is placed between the first and the second shoulder and a third pressure space 15 is provided at said part, where the pressure fluid may flow between the first percussion piston and the frame from this space to the control valve 7. This pressure space communicates through a first control channel 16 with the control valve 7. The second percussion piston comprises corresponding parts, i.e. the first shoulder 4*a* thereof, and the first pressure surface 4*b* thereof, the second shoulder 4*c* thereof, the second pressure surface 4*d* thereof, the extension 4*e* thereof and the third shoulder 4*f* thereof. Correspondingly the second percussion piston 4 is surrounded at the front end thereof with a first pressure space 17 thereof, to which the first pressure surface 4*b* thereof is connected and to which the pump 11 continuously supplies high-pressure pressure fluid through the channel 12. Correspondingly the back end of the second percussion piston, i.e. on the right in the Figure, comprises its second pressure space 18, which communicates through a channel 19 with the control valve 7 for the most part of the percussion motion of the second percussion piston 4, although the second shoulder 4*c* of the second percussion piston closes the connection at the end of the return motion of the second percussion piston. Furthermore, a third pressure space 20 thereof is provided between the first and second shoulder that is connected through the second control channel 21 to the control valve 7 and also therefrom towards the back end of the percussion piston, i.e. to the right in the Figure, connected at a distance through a channel 22 to what is known as the tank pressure, or a low pressure, or a pressure medium tank or to a discharge channel leading thereto.

The Figures show the third pressure spaces 15 and 20 surrounding both percussion pistons. Instead of these, the percussion pistons may comprise a separate groove in order to obtain the control. Instead of only one groove, the number of grooves may be larger either in the longitudinal direction of the percussion piston or around the periphery thereof. Also in connection with the first percussion piston, instead of connecting by means of the first groove in the first percussion piston the control channel 16 leading to the control valve 7 to the first pressure space 10 of the first percussion piston, a separate high-pressure channel can be used, to which the groove connects the first control channel in the same way as the second control channel 21 is correspondingly connected to the separate discharge channel 22 of the pressure fluid in the second percussion piston. Instead of forming the grooves of the percussion pistons between the first and second pressure space, the grooves for controlling the control valve can also be formed in another appropriate place in the percussion piston, for example on the third shoulder etc. provided as the extension of the percussion pistons.

The control valve 7 comprises a valve slide 8, which is constantly affected by a force F pushing the slide to the left in the Figure. This is by way of example achieved in such a manner that a pressure equal in size acts on both ends of the slide, for instance the high pressure of the pressure fluid supplied from the pump 11 in the Figure. Since the edge surfaces of the slide 8 vary in size, a force acts thereupon as a whole that is the product of the difference and the pressure between the edge surface areas. Such a force F could be achieved only, for instance, with a pressure of the pressure medium affecting the right end in the Figure, a spring or in some other known manner, for example electrically or magnetically, as long as the end result is a force that pushes the slide 8 in the Figure to the left. The slide 8 also comprises control channels 8*a* and 8*b*, which alternately allow the pressure fluid to flow through the slide 8 when the slide 8 is in a particular position. The control channels 8*a* and 8*b* may for instance be channels leading through the slide 8 or grooves surrounding it in a manner known per se. Furthermore the control valve 7 comprises control spaces 23, 24 and 25. The slide controls the second pressure space 13 of the first percussion piston through the pressure space 23 to alternately communicate with the high-pressure pressure fluid or the pressure medium tank, i.e. with what is known as the tank pressure, and correspondingly the second pressure space 18 surrounding the second percussion piston through the control space 24 alternately to communicate with the high-pressure pressure medium or the tank pressure. A third control space 25 in turn functions as a controller of the movement of the slide 8 affected by the percussion pistons 1 and 4, whereby, as the high-pressure pressure medium acts on the control space 25, the slide 8 moves to the right in the Figure and correspondingly when a low pressure acts thereupon, whereby the force tending to move the slide to the right is smaller than the force F pushing the slide to the left, the slide 8 moves into the position shown in the Figure. This is due to the fact that the slide of the valve comprises a pressure surface 26, to which the pressure achieved by the affecting pressure fluid provides a force, which moves the slide 8 to the right in the Figure against the force F. Thus, the movement of the slide can be controlled either by letting the high pressure of the pressure fluid affect the control space or by connecting it to the low pressure, for instance to the discharge channel of the pressure fluid. The slide of the valve 8 may be a closed slide or it may be a sleeve-like or any other type of slide known per se.

FIG. 1 shows a situation, where the first percussion piston 1 is starting a percussion motion and the second percussion piston has just delivered a stroke, i.e. is still at the percussion point. In such a situation, a high pressure of the pressure fluid acting through the channel opened by a third shoulder 1*f* affects a second pressure surface 1*g* of the first percussion piston. As the same pressure acts upon the pressure surfaces 1*b* and 1*d*, the surface area difference of the pressure surfaces causes the fact that the first percussion piston 1 starts the percussion motion. At the same time, as the second pressure space 18 at the back end of the second percussion piston is connected through the channel 19 to the second control space 24 of the control valve 7 and also to the low pressure through the control channel 8*b* therein, the second percussion piston correspondingly starts by the effect of the continuous high pressure at the front end thereof to move backwards from the percussion point, i.e. to the right in the Figure. As the first percussion piston moves a distance in the percussion direction, the third shoulder 1*f* thereof closes the connection of the high-pressure pressure fluid channel to the second pressure surface 1*d*, but correspondingly the second shoulder 1*c* opens a connection between the channel 14 starting from the valve 7 and the second pressure space, in which case the pressure fluid supplied from the pump 11 is able to flow through the control space 23 to the second pressure space 13 of the first percussion piston 1 affecting the second pressure surface 1*d*. Consequently, the first percussion piston 1 continues the percussion motion thereof.

Figure 2:
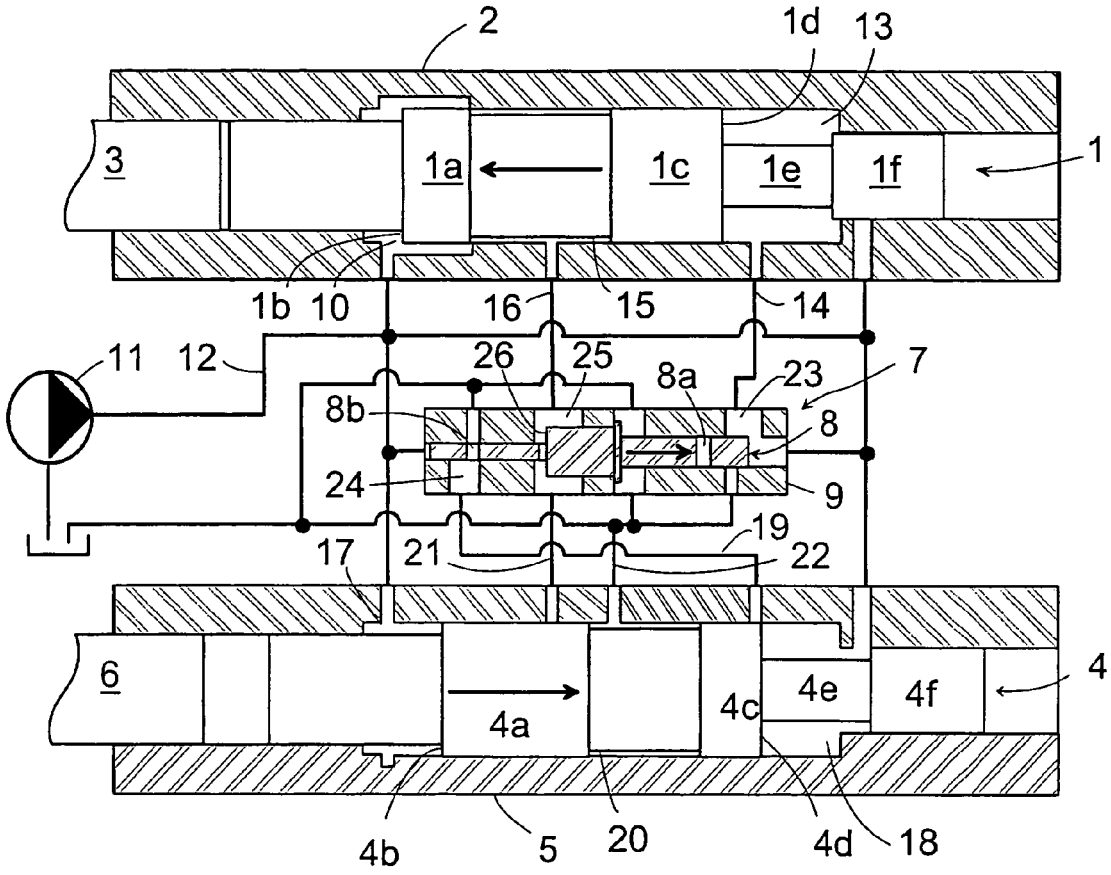

FIG. 2 shows a situation, in which the first percussion piston has proceeded close to the percussion point and correspondingly the second percussion piston has moved backwards so that the second shoulder 4*a* in the second percussion piston has closed the connection from the third control space 25 of the control valve to the low pressure. When the first shoulder 1*a* in the first percussion piston 1 moves further to the left in the Figure, i.e. to the percussion direction, a connection opens from the first pressure space 10 to the third control space 25 of the control valve through the third pressure space 15, in which case the high-pressure pressure acts on the pressure surface 26 of the slide of the control valve and consequently the slide 8 starts to move to the right in the Figure. From this moment, the first percussion piston still continues the percussion motion thereof, since the high-pressure pressure fluid still affects the second pressure surface 1*d*.

Figure 3:
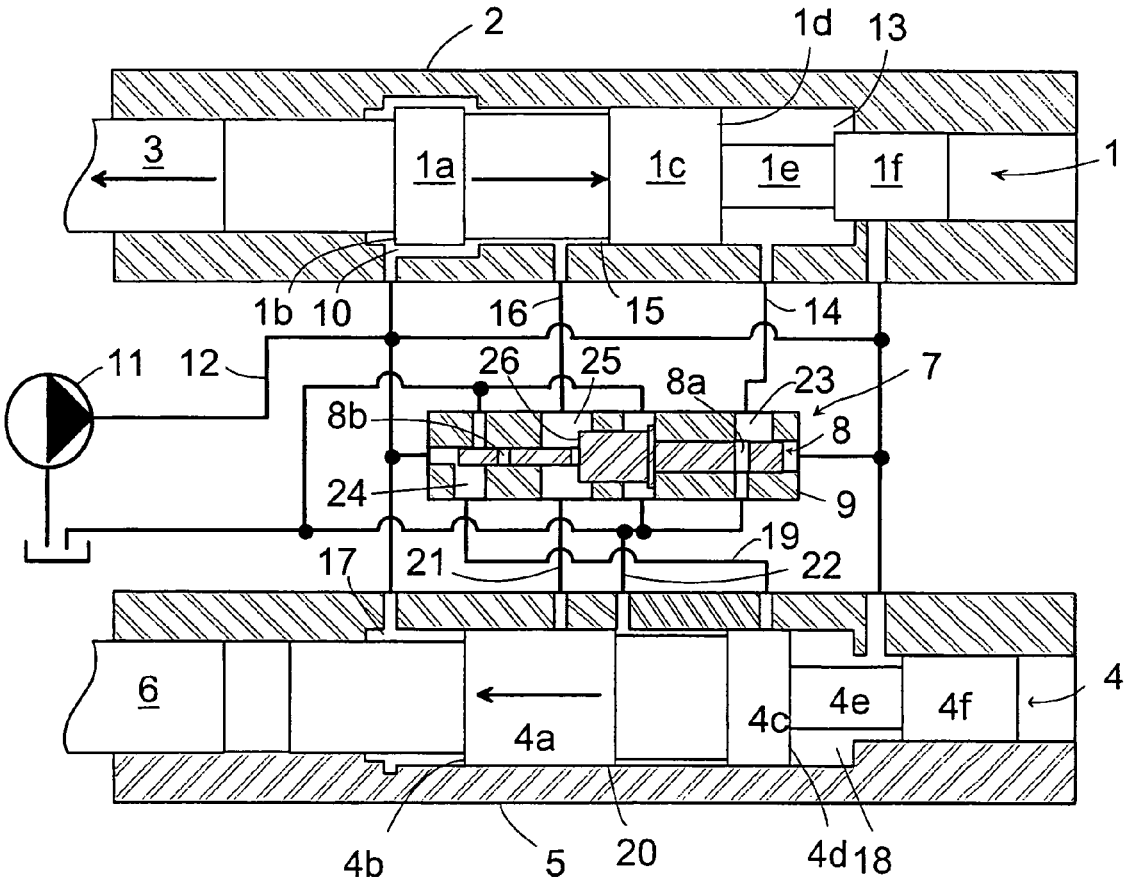

FIG. 3 illustrates a situation, in which the first percussion piston has struck the tool 3, thus being at what is known as the percussion point. The second percussion piston has correspondingly stopped, since the third shoulder 4*f* on the extension thereof has opened a connection from the high-pressure pressure fluid to the second pressure space 18 thereof. When the slide 8 of the valve has moved to the right as shown in the Figure, a connection has opened from the second pressure space 13 at the end of the first percussion piston through the control channel 8*a* to the low pressure, or tank pressure, whereby the pressure in the high-pressure pressure-fluid at the front end of the first percussion piston results in that the first percussion piston starts to return backwards, i.e. to the right in the Figure. The second percussion piston simultaneously starts a percussion motion forwards, i.e. to the left in the Figure, since the force provided by the pressure of the pressure fluid affecting the pressure surfaces 4*b* and 4*d* therein pushes the second percussion piston in that direction because of the difference between the surface-areas of the pressure surfaces.

Figure 4:
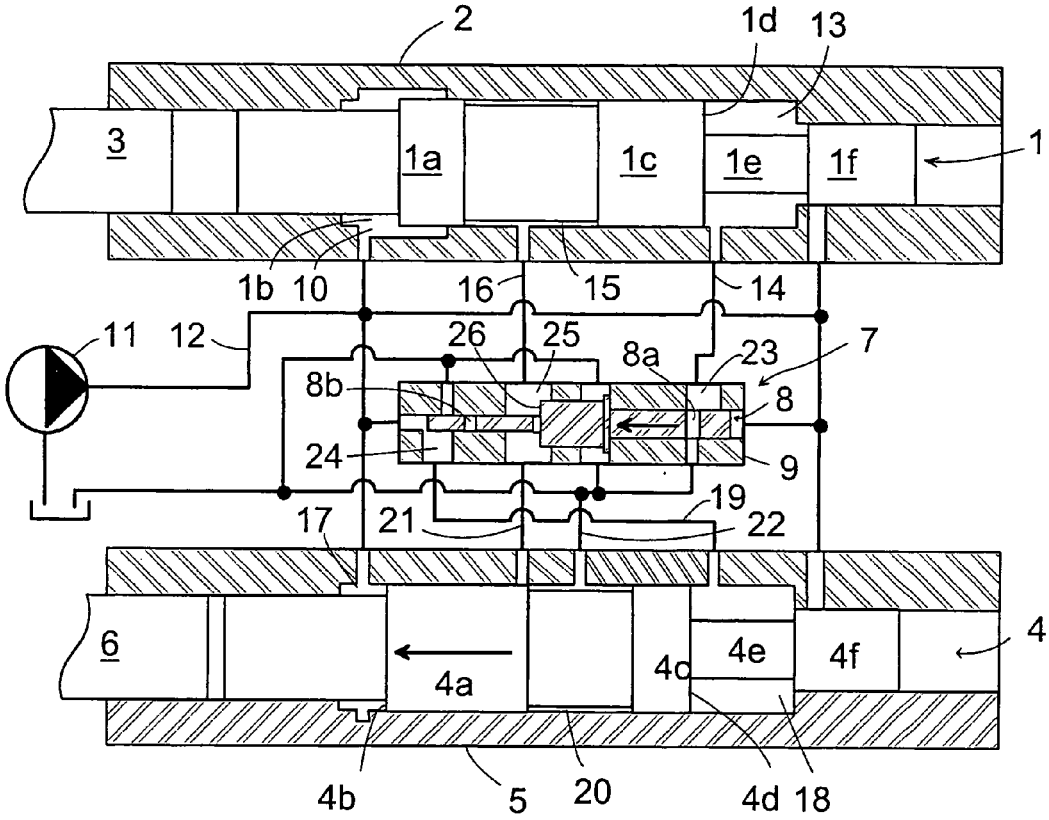

FIG. 4 shows in turn a situation in which the first percussion piston has moved almost to the back position thereof. In such a situation the shoulder 1*c* opens a connection through the channel 14 from the second pressure space 13 to the high-pressure pressure fluid, which thus stops the percussion piston and starts a new percussion motion. The second shoulder 1*c* in the first percussion piston 1 also closes in this situation the connection from the second pressure space 13 to the control valve 7. Likewise, the connection of the third pressure space 15 between the first and the second shoulder 1*a* and 1*c* is closed to the first pressure space. While the second percussion piston has moved to a point indicated in the Figure, a third shoulder at the back end thereof has previously closed the direct connection to the high-pressure pressure fluid and the second pressure space 18 thereof obtains high-pressure pressure fluid from the control valve 7 through the control space 24 and the channel 19 so that the second percussion piston 4 continues the percussion motion thereof. At such a moment, a connection is opened from the pressure space 20 between the first and second shoulders to the third control space 25 of the control valve, from where the high-pressure pressure acting thereon is discharged through the third pressure space 20, and the slide 8 of the control valve 7 starts to move to the left. As a result, the process ends again in the situation shown in FIG. 1, from where a new percussion session starts.

Figure 5:
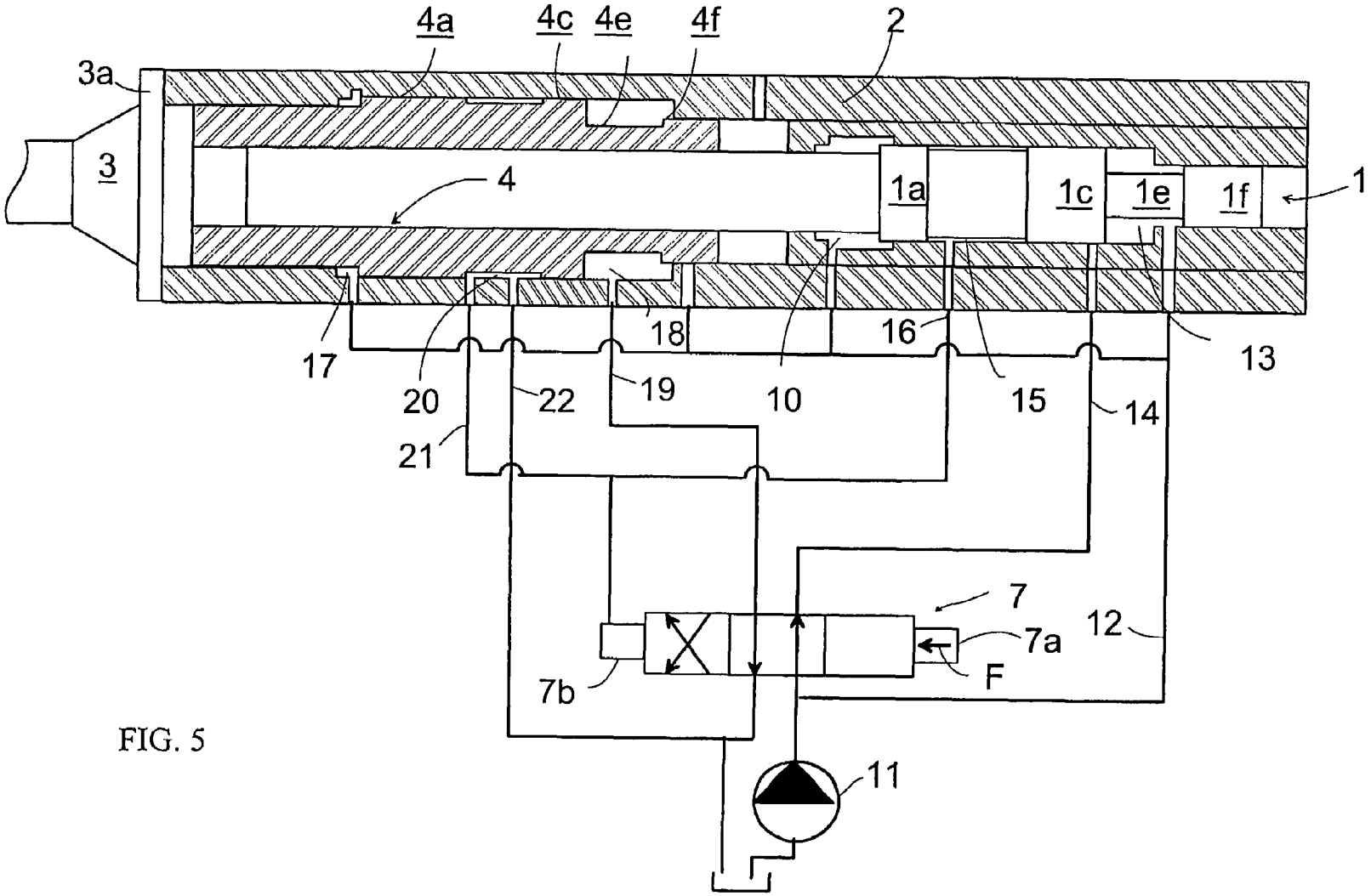

FIG. 5 schematically shows another embodiment of the percussion device according to the invention. In this embodiment the pistons 1 and 4 are placed co-axially within one another in relation to each other so that both alternately strike the same tool or shank. The first percussion piston is a percussion piston of standard type and is placed co-axially regarding the tool 3. A second sleeve-like percussion piston 4 surrounds the first percussion piston 1. In this embodiment the first percussion piston 1 extends in the axial direction, in the opposite direction as regards the tool, outside the second percussion piston 4 so that the grooves, shoulders and pressure spaces. required for the operation of the whole percussion device and the percussion piston 1 can be formed, on the one hand to the first percussion piston along the length extending outside said second percussion piston, and on the other hand the required grooves, shoulders and channels are correspondingly provided at the same positions in the frame. In this embodiment, the percussion pistons operate similarly as in the embodiment of the invention illustrated in FIGS. 1 to 4. However, in this embodiment the valve is shown schematically to point out that basically any known valve solution may function as the valve, as long as it controls the percussion pistons as shown above and as long as the control thereof is based on the position of the percussion pistons at the front end of the percussion motion thereof as described above.

In the embodiment shown in FIG. 5, the control channels of the percussion pistons are connected so that they are each placed outside the percussion piston thereof and as regards the percussion piston 1 at the back end thereof so that they are placed successively in the axial direction of the percussion device. In this embodiment of the invention, the length of the inner first percussion piston 1 exceeds the length of the outer sleeve-like second percussion piston 4 in order to provide the back end thereof with the required shoulders and pressure spaces. As to the other parts, the operation corresponds with the operation of the percussion device described in FIGS. 1 to 4. The operation of the control valve 7 is schematically shown in blocks, whereby one end of the control valve 7 schematically shows a force element 7*a* , which may affect the force F tending to move the slide of the control valve 7 in a particular direction. The force element 7*a* may be an electrical spool, a pressure medium pressure may be provided thereto acting so as to push the slide in a particular direction, or it may be a mechanical spring or a compressing material such as gas or another material in the space at the end of the valve slide 8, said material being already compressed in a normal position of the valve tending to keep the slide 8 of the valve 7 in a particular position. Correspondingly a control element 7*b* controlled by the pressure provided through the percussion pistons is described at the other end of the valve 7 as a loading element, which in practise is a pressure medium space communicating with the slide of the valve and with the pressure surface therein, the channels 16 and 21 arriving from the third pressure medium spaces 15 and 20 of both percussion pistons being connected to said pressure medium space.

In this embodiment, the tool 3 has at the end of the percussion pistons, for instance as shown in FIG. 5, a diameter that is greater than a standard diameter thereof in order to be able to provide an impact surface on the tool or the shank at the sleeve-like second percussion piston 4. Such an extension 3*a* of the tool or the shank 3 can naturally be implemented in various ways and the embodiment shown here is merely referential.

Figure 6:
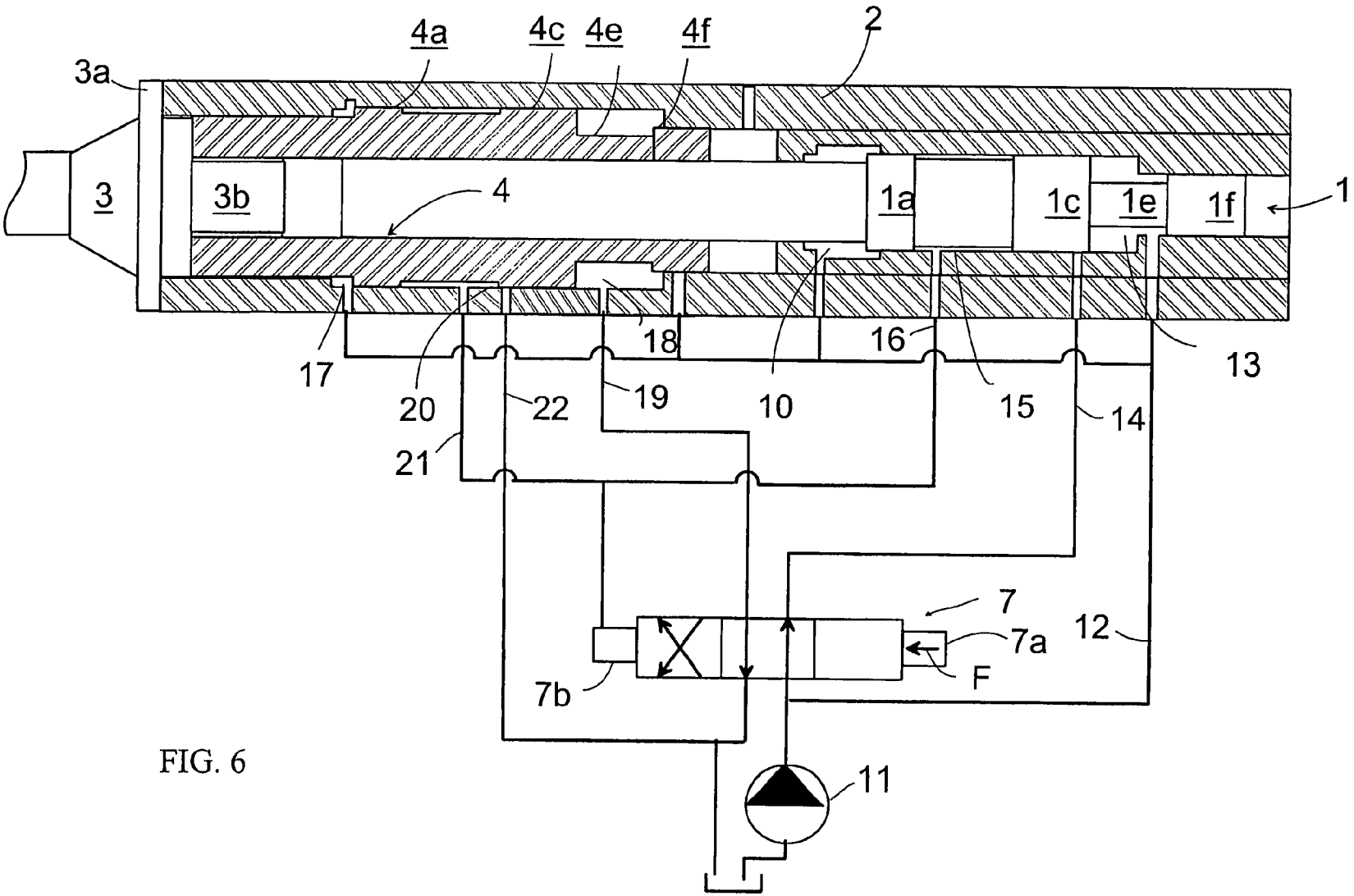

FIG. 6 schematically shows a third embodiment of the percussion device according to the invention. The basis for this embodiment is that the length of the percussion pistons affects the properties of an impact pulse achieved thereby, in which case the percussion pistons of different lengths provide the tool with different impact pulses. Even though this is useful in some cases, it is necessary in other cases to provide the tool with impact pulses, which are as similar as possible. For such a purpose, the length of the first inner percussion piston 1 is reduced so that a pin-like protruding part 3*b* extending inside the second percussion piston 4 is provided as the extension of the tool or shank 3, which protruding part 3 the first percussion piston strikes, and correspondingly the second percussion piston 4 further strikes, as shown in FIG. 5, the impact surface of the tool or the shank 3. As to the other parts, the embodiment of the invention shown in FIG. 6 operates in the same way as the embodiment of the invention shown in FIG. 5. As a result of the pin-like protruding part, the impact pulse of the inner percussion piston 1 becomes longer.

Figure 7:
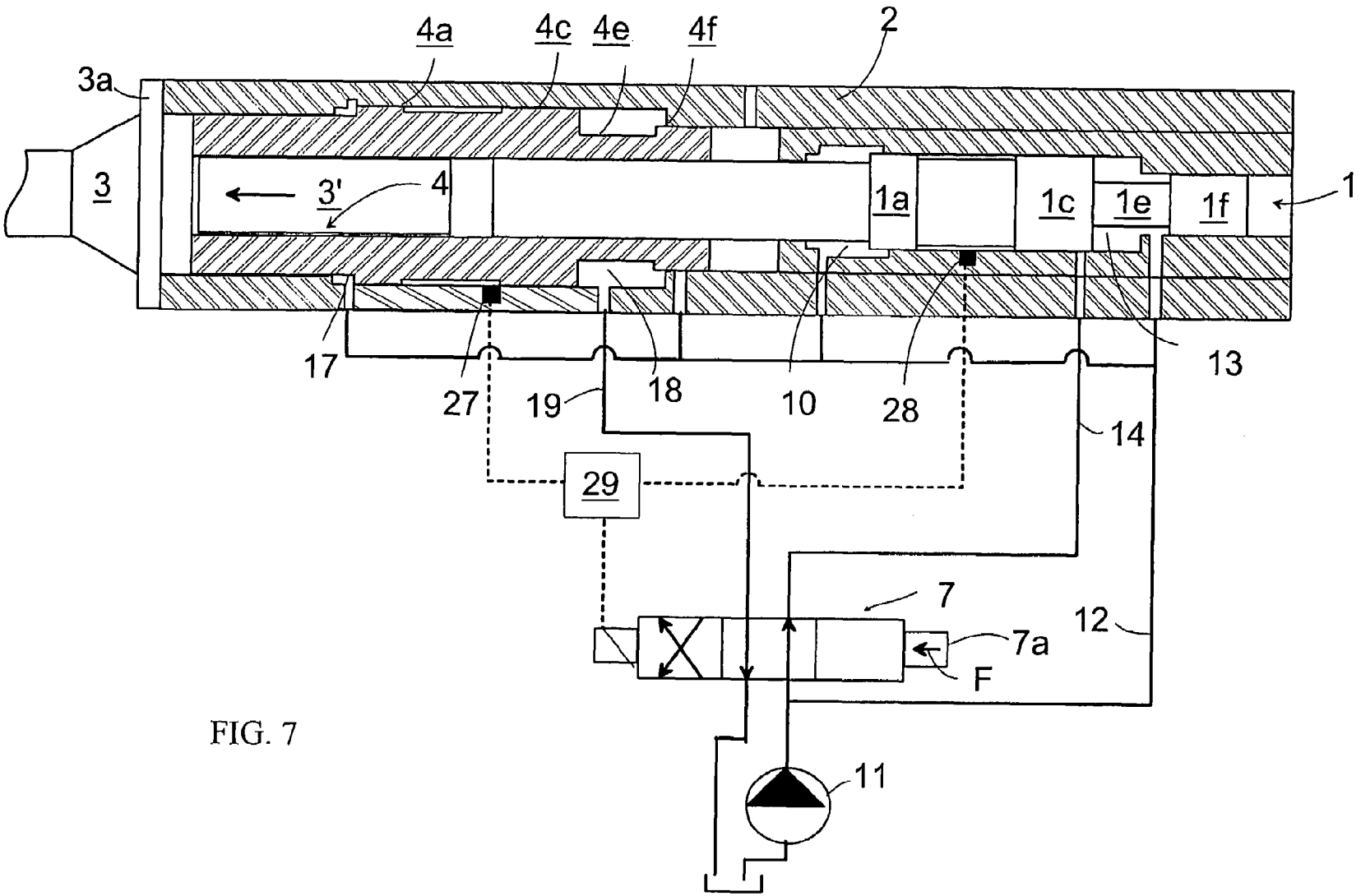

FIG. 7 schematically shows a fourth embodiment of the percussion device according to the invention. In this embodiment, a separate unattached fitting element is placed between the inner first percussion piston 1 and the tool or shank 3 that allows holding the length of the first percussion piston 1 regarding the properties of the impact pulse as close as possible to the desired. A separate connecting piece 3' delivers the impact of the first percussion piston 1 to the tool or shank 3, but otherwise does not affect the structure or operation thereof. In order for the impact of the first percussion piston 1 to strike the tool or shank as effectively as possible, the connecting piece 3' is provided with an appropriate affecting force, for instance using a pressure fluid or some other medium, so that good contact is always maintained with the actual impact surface of the tool or shank 3 at the percussion point. In this embodiment, the control of the control valve is also schematically shown using electrical control. Electrical sensors 27 and 28 placed adjacent to the percussion pistons 1 and 4 are electrically connected to a control unit 29 that the dashed lines from the sensors 27 and 28 to the control unit 29 schematically illustrate. Correspondingly the control unit 29 is electrically connected to control the control valve 7 that the dashed line from the control unit 29 to the valve 7 schematically illustrates. As the percussion piston approaches a predetermined point at the end of the percussion motion thereof, the sensor 27 or 28 provides an electric impulse to the control unit 29, which consequently controls the control valve from the position thereof to another position and correspondingly when the second percussion piston approaches the end of the percussion motion thereof and controls the control valve based on the signal provided from the sensor back to the previous position thereof.

Instead of the embodiments described in FIGS. 5 to 7, such an embodiment can also be used in which the inner first percussion piston comprises a reverse solution for obtaining and controlling the motion of the percussion piston. In such an embodiment, an axial recess is provided inside the first percussion piston 1, and the shoulders, pressure surfaces, grooves and channels required in the percussion piston are formed on the inner surface of the recess in order to provide the percussion motion of the percussion piston and for controlling the percussion motion. Correspondingly, a frame part belonging to the frame extends to the recess, and the channels, shoulders etc. of the frame surrounding the percussion piston 1 and corresponding with the embodiments shown in FIGS. 5 to 7 are placed on the outer surface of the frame part. Hence, a solution can be provided where the length of the percussion pistons is precisely the same and the entire length of the percussion device is as short as possible.

The invention has merely been explained by way of example in the specification and the drawings, but is not in any way restricted thereto. What is essential is that the re-start of the percussion motion during the return motion of the percussion pistons is based merely on the position of the percussion piston during the return motion thereof and that the control of the control valve is based on the position of the percussion piston at the end of the percussion motion of the percussion piston so that when the first percussion piston is in a predetermined position the control valve obtains a high-pressure control pressure and changes the position thereof and connects the percussion piston to the return motion irrespective of the position of the second percussion piston at that particular moment and correspondingly when the second percussion piston of the control valve is in a predetermined position connects a low control pressure to the control valve, whereby the control valve again changes the position thereof and connects the second percussion piston to the return motion.

The invention claimed is:

1. A percussion device comprising:

first and second percussion pistons alternately making a percussion motion and a control valve for controlling the percussion pistons, where both percussion pistons are provided with a first pressure space and both percussion pistons comprise a first pressure surface facing a tool and communicating with said first pressure space, both percussion pistons comprise at the back end thereof a second pressure space and both percussion pistons comprise a second pressure surface directed backwards and with a surface area that is larger than that of the first pressure surface communicating with the second pressure space, whereby the pressure of the pressure fluid is constantly high in the first pressure space during the operation of the percussion device, and whereby the second pressure space of both percussion pistons is connected to a high pressure channel and correspondingly a discharge channel in order to alternately obtain a percussion motion and correspondingly a return motion, and control means for controlling the control valve with the percussion motion of both percussion pistons, whereby the control valve comprises a slide affected by a force in the direction of motion thereof so that the slide is generally in a first position thereof, wherein in the first position of the slide the control valve connects the high pressure channel to a channel leading to the second pressure space of the first percussion piston and connects the discharge channel to a channel leading to the second pressure space of the second percussion piston, wherein the control means are connected to act on the slide of the control valve at the end of the percussion motion of the first percussion piston so that the slide moves from the first position to a second position, whereby the control valve connects the second pressure space of the first percussion piston to the discharge channel of the pressure fluid and connects the high pressure channel to a channel leading to the second pressure space of the second percussion piston, and wherein the control means are connected at the end of the percussion motion of the second percussion piston to act on the slide of the control valve so that the slide again moves from the second position to the first position;

wherein the control means comprise first and second grooves on first and second percussion pistons, respectively, each of said percussion pistons being part of the control means, the slide of the control valve comprises a pressure surface, a pressure of the pressure fluid acting on the pressure surface causes an opposite force in relation to the force affecting the slide, wherein a first control channel leads from the first percussion piston to the control valve that communicates through the first groove at the end of the percussion motion of the first percussion piston with the high pressure of the pressure fluid so that said pressure is able to act upon the pressure surface of the slide of the control valve in order to move the slide from the first position to the second position, and wherein a second control channel leads from the second percussion piston to the control valve that communicates at the end of the percussion motion of the second percussion piston through the second groove with the discharge channel of the pressure fluid so that the high-pressure pressure fluid affecting the slide of the control valve can be discharged onto the discharge channel and the slide moves again to the first position thereof.

2. A percussion device as claimed in claim 1, wherein the force affecting the slide of the control valve is formed by setting a high pressure of the pressure fluid to act upon one end of the slide.

3. A percussion device as claimed in claim 2, wherein a high pressure of the pressure fluid is provided to act on the slide of the control valve, on the pressure surfaces facing one another at the end of the slide, the size of the surface areas thereof being different so that a force acting in one direction in the axial direction thereof acts on the slide.

4. A percussion device as claimed in claim 1, wherein the force affecting the slide of the control valve is provided with a spring.

5. The percussion device as claimed in claim 1, wherein the first and second grooves each form include a third pressure space surrounding the first and second percussion pistons, respectively.

6. A percussion device comprising:

first and second percussion pistons alternately making a percussion motion and a control valve for controlling the percussion pistons, where both percussion pistons are provided with a first pressure space and both percussion pistons comprise a first pressure surface facing a tool and communicating with said first pressure space, both percussion pistons comprise at the back end thereof a second pressure space and both percussion pistons comprise a second pressure surface directed backwards and with a surface area that is larger than that of the first pressure surface communicating with the second pressure space, whereby the pressure of the pressure fluid is constantly high in the first pressure space during the operation of the percussion device, and whereby the second pressure space of both percussion pistons is connected to a high pressure channel and correspondingly to a discharge channel in order to alternately obtain a percussion motion and correspondingly a return motion, and control means for controlling the control valve with the percussion motion of both percussion pistons, whereby the control valve comprises a slide affected by a force in the direction of motion thereof so that the slide is generally in a first position thereof, wherein in the first position of the slide the control valve connects the high pressure channel to a channel leading to the second pressure space of the first percussion piston and correspondingly connects the second pressure space of the second percussion piston to the discharge channel of the pressure fluid, wherein the control means are connected to act on the slide of the control valve at the end of the percussion motion of the first percussion piston so that the slide moves from the first position to a second position, whereby the control valve connects the second pressure space of the first percussion piston to the discharge channel of the pressure fluid and connects the high pressure channel to a channel leading to the second pressure space of the second percussion piston, wherein the control means are connected at the end of the percussion motion of the second percussion piston to act on the slide of the control valve so that the slide again moves from the second position to the first position, and wherein the force affecting the slide of the control valve is electrically or magnetically provided.

7. A percussion device comprising:

first and second percussion pistons alternately making a percussion motion and a control valve for controlling the percussion pistons, where both percussion pistons are provided with a first pressure space and both percussion pistons comprise a first pressure surface facing a tool and communicating with said first pressure space, both percussion pistons comprise at the back end thereof a second pressure space and both percussion pistons comprise a second pressure surface directed backwards and with a surface area that is larger than that of the first pressure surface communicating with the second pressure space, whereby the pressure of the pressure fluid is constantly high in the first pressure space during the operation of the percussion device, and whereby the second pressure space of both percussion pistons is connected to a high pressure channel and correspondingly to a discharge channel in order to alternately obtain a percussion motion and correspondingly a return motion, and control means for controlling the control valve with the percussion motion of both percussion pistons, whereby the control valve comprises a slide affected by a force in the direction of motion thereof so that the slide is generally in a first position thereof, wherein in the first position of the slide the control valve connects the high pressure channel to a channel leading to the second pressure space of the first percussion piston and correspondingly connects the second pressure space of the second percussion piston to the discharge channel of the pressure fluid, wherein the control means are connected to act on the slide of the control valve at the end of the percussion motion of the first percussion piston so that the slide moves from the first position to a second position, whereby the control valve connects the second pressure space of the first percussion piston to the discharge channel of the pressure fluid and the high pressure channel to a second pressure space of the second percussion piston, wherein the control means are connected at the end of the percussion motion of the second percussion piston to act on the slide of the control valve so that the slide again moves from the second position to the first position, and wherein both percussion pistons comprise an extension at the end facing away from the tool and a shoulder in the extension and a high-pressure pressure fluid channel is connected to the path of the shoulder so that the shoulder moves away from the particular position at the end of the return motion of the percussion piston allowing the high-pressure pressure fluid to act on the percussion piston in order to start the percussion motion, whereby the shoulder again closes said connection when the percussion motion of the percussion piston has started and the percussion motion of the percussion piston continues by the effect of the high-pressure pressure fluid provided from the control valve.

8. A percussion device comprising:

first and second percussion pistons alternately making a percussion motion and a control valve for controlling the percussion pistons, where both percussion pistons are provided with a first pressure space and both percussion pistons comprise a first pressure surface facing a tool and communicating with said first pressure space, both percussion pistons comprise at the back end thereof a second pressure space and both percussion pistons comprise a second pressure surface directed backwards and with a surface area that is larger than that of the first pressure surface communicating with the second pressure space, whereby the pressure of the pressure fluid is constantly high in the first pressure space during the operation of the percussion device, and whereby the second pressure space of both percussion pistons is connected to a high pressure channel and correspondingly to a discharge channel in order to alternately obtain a percussion motion and correspondingly a return motion, and control means for controlling the control valve with the percussion motion of both percussion pistons, whereby the control valve comprises a slide affected by a force in the direction of motion thereof so that the slide is generally in a first position thereof, wherein in the first position of the slide the control valve connects the high pressure channel to a channel leading to the second pressure space of the first percussion piston and correspondingly connects the second pressure space of the second percussion piston to the discharge channel of the pressure fluid, wherein the control means are connected to act on the slide of the control valve at the end of the percussion motion of the first percussion piston so that the slide moves from the first position to a second position, whereby the control valve connects the second pressure space of the first percussion piston to the discharge channel of the pressure fluid and connects the high pressure channel to a second pressure space of the second percussion piston, wherein the control means are connected at the end of the percussion motion of the second percussion piston to act on the slide of the control valve so that the slide again moves from the second position to the first position, and wherein the second percussion piston is sleeve-like and the percussion pistons are mutually situated co-axially one within the other and alternately strike the same tool or shank.

9. A percussion device as claimed in claim 8, wherein the first, inner percussion piston extends beyond the second, outer percussion piston in the axial direction from the side that faces away from the tool and that the pressure channels and shoulders required for controlling the percussion operation are placed in the first percussion piston in the part that extends backwards from the second percussion piston.

10. A percussion device as claimed in claim 8, wherein the first percussion piston comprises at the end facing away from the tool a recess in the axial direction, that the channels and pressure spaces required to achieve the percussion operation of the first percussion piston are formed into the first percussion piston on the inner surface of said recess and that the percussion device comprises a frame part that extends to said recess and comprises the channels and shoulders essential for the operation of the percussion device.

* * * * *